US006885143B2

(12) United States Patent
Kim

(10) Patent No.: US 6,885,143 B2
(45) Date of Patent: Apr. 26, 2005

(54) CATHODE RAY TUBE WITH OFFSET DEFLECTION CENTER

(75) Inventor: Hyuk Dong Kim, Daegu-si (KR)

(73) Assignee: LG. Philips Displays Korea Co., Ltd., Gyeongsangbuk-Do (KR)

( * ) Notice: Subject to any disclaimer, the term of this patent is extended or adjusted under 35 U.S.C. 154(b) by 68 days.

(21) Appl. No.: 10/391,789

(22) Filed: Mar. 20, 2003

(65) Prior Publication Data

US 2004/0051437 A1 Mar. 18, 2004

(30) Foreign Application Priority Data

Sep. 13, 2002 (KR) ..... 10-2002-0055879

(51) Int. Cl.[7] ..... H01J 61/30; H01J 31/00

(52) U.S. Cl. ..... 313/477 R; 313/461; 313/473; 313/474; 313/440; 220/2.1 R; 220/2.1 A; 220/2.3 R; 220/2.3 A; 315/370; 315/399; 335/210; 335/212; 335/213; 335/214

(58) Field of Search ..... 313/440, 430, 313/412, 413, 477 R, 461; 220/2.1 A, 2.1 R, 2.3 A, 2.3 R

(56) References Cited

U.S. PATENT DOCUMENTS

| | | | | |
|---|---|---|---|---|
| 6,160,344 A | * 12/2000 | Cho et al. | ..... | 313/477 R |
| 6,166,484 A | * 12/2000 | Okuyama et al. | ..... | 313/440 |
| 6,359,379 B1 | * 3/2002 | Lee et al. | ..... | 313/477 R |
| 6,388,373 B1 | * 5/2002 | Nah | ..... | 313/474 |
| 2004/0000860 A1 | * 1/2004 | Jung | ..... | 313/477 R |

FOREIGN PATENT DOCUMENTS

| | | | | |
|---|---|---|---|---|
| JP | 3-165427 A | 7/1997 | ..... | H01J/29/76 |
| JP | 10-188849 A | 7/1998 | ..... | H01J/29/76 |
| JP | 11-238479 A | 8/1999 | ..... | H01J/29/76 |
| KR | 2002076830 A | * 10/2002 | ..... | H01J/29/02 |

* cited by examiner

*Primary Examiner*—Nimeshkumar D. Patel
*Assistant Examiner*—Sikha Roy
(74) *Attorney, Agent, or Firm*—Birch Stewart Kolasch & Birch, LLP

(57) ABSTRACT

A cathode ray tube is provided, and more particularly, a cost-effective cathode ray tube effective for minimizing deterioration of color purity and obtaining a sufficient margin for a beam strike neck (BSN) phenomenon by moving a ½ center (deflection center) closer to a panel without changing the curvature of a funnel or the thickness of a glass inside the funnel.

19 Claims, 5 Drawing Sheets

CATHODE RAY TUBE WITH OFFSET DEFLECTION CENTER

BACKGROUND OF THE INVENTION

1. Field of the Invention

The present invention relates to a cathode ray tube. More particularly, the present invention relates to a cost-effective cathode ray tube effective for minimizing deterioration of color purity and obtaining a sufficient margin for a beam strike neck (BSN) phenomenon by moving a ½ center (deflection center) closer to a panel without changing the curvature of a funnel or the thickness of a glass inside the funnel.

2. Background of the Related Art

FIG. 1 is a diagram explaining the structure of a generally known color cathode ray tube in a related art.

The color cathode ray tube has a fluorescent screen on a front surface of a cone-shaped vacuum tube, and there is an electron gun and a deflection yoke in a neck portion on the opposite side of the screen, whereby electron beams emitted from the electron gun are deflected and collided with the fluorescent screen to display an image.

As depicted in FIG. 1, a panel 1 and a funnel 2 of the color cathode ray tube are sealed up tightly together, so the inside of the cathode ray tube is generally in a vacuum state.

Speaking of the construction of the cathode ray tube, the fluorescent screen 3 with red (R), green (G) and blue (B) primary color phosphors (or fluorescent substances) is formed inside of the panel 1, and the electron gun 4 for emitting three color electron beams 7, namely red, green and blue, is installed in the neck portion of the funnel on the opposite side of the fluorescent screen 3.

A shadow mask 5 is disposed at a predetermined space between the fluorescent screen 3 and the electron gun 4, more specifically, closer to the fluorescent screen 3, for selecting colors. Also, in order to restrict the motion of the electron beams 7 promoted by a magnetic field, an inner shield 6, which is made of magnetic substance, is provided to a rear side of the brown tube to diminish an influence of a magnetic field thereon.

Meanwhile, there is a convergence purity correcting magnet (CPM) 8 around the neck portion of the funnel 2, which serves to adjust R, G and B electron beams emitted from the electron gun 4 to be converged to one single point, and in front of the magnet 8, there is a deflection yoke 9 for deflecting the electron beams 7.

In addition, a band 10 is put on the external skirt area of the panel, so as to reinforce a front surface glass with the presence of a high internal vacuum state (e.g. $10^{-7}$ Torr–$10^{-8}$ Torr).

To briefly explain how the color cathode ray tube with the above construction operates, the electron beams 7 emitted from the electron gun 4 are deflected in the horizontal and vertical directions according to the deflection yoke 9, and the deflected electron beams 7 pass through a beam passing hole on the shadow mask 5 and eventually strike the fluorescent screen 3 on the front side, thereby displaying a desired color image.

Particularly, the CPM 8 corrects convergence and purity of R, G and B electron beams 7, and the inner shield 6, as it says, shields the rear cathode ray tube from the influence of the magnetic field.

As discussed before, the cathode ray tube is a high vacuum tube, meaning it is highly explosive by an external shock. For this reason, the panel is usually designed to be very strong enough to withstand atmospheric pressure.

Also, the band 10 put on the external skirt area of the panel 1 serves to disperse the tension on the high vacuum cathode ray tube, thereby providing the impact resistance to the tube.

FIG. 2 illustrates a cathode ray tube whose outer surface is substantially flat and inner surface has a predetermined curvature. Referring to the drawing, the cathode ray tube consists of a rectangular shaped panel 1 with a skirt area, the skirt area being vertically extended from the outer and inner surface, a funnel 2 coupled to a seal edge portion of the panel 1, a deflection yoke 9 for deflection electron beams, and an electron gun 4 for emitting electron beams. Particularly, FIG. 2 indicates that there is an area where a fluorescent screen inside the panel 1 gives little or no light. This phenomenon occurs because the electron beams deflected by the deflection yoke 9 strike the inner surface of the neck portion of the funnel, and they sometimes create an area that cannot radiate the screen mainly because the panel 1 nowadays is very light and slim.

In FIG. 2, reference numeral 1*a* suggests how big the panel used to be before it became much lighter; reference Ea shows the end of an effective surface of the screen from the old, heavy panel; reference numeral 1*b* suggests a panel after it became light; and reference Eb shows the end of an effective surface of the screen from the light panel.

Further, reference numeral 9*a* indicates a ferrite core; reference numeral 9*b* indicates an opening part of the deflection yoke; reference numeral 2*a* indicates a funnel curvature before and after the panel became light; and reference numeral 2*b* indicates a newly suggested funnel curvature to obtain a more margin of BSN.

Also, OAH (x) indicates the distance from the center on the outer surface of the panel to the center on an extended plane of a skirt seal edge part; and C indicates a deflection center, that is, a ½ center (or midpoint) of the ferrite core 9*a*.

As illustrated in FIG. 2, from a mechanical sense, the deflection center of the deflection yoke 9 could be overlapped with the ½ center (C), on the ferrite core 9*a*. On the other hand, assuming that a coordinate axis (or reference line) exists around the ½ center (C), if an angle ($\alpha$) between a vertical coordinate axis passing the ½ center on the ferrite core 9*a* and the end (Ea) of the effective surface of the screen from the old, heavy panel is determined, a margin for the funnel's deflection angle is created, and from there, a margin of beam strike neck is created also.

However, this does not happen to the light, slim panel 1 though. That is, if OAH (x) is reduced, the angle ($\beta$) between the vertical coordinate axis passing the ½ center on the ferrite core 9*a* and the end (Eb) of the effective surface of the screen from the light, slim panel 1 becomes greater than the angle ($\alpha$). As a result thereof, the margin of the deflection angle of the funnel is decreased, and therefore, the margin of the beam strike neck is decreased as well.

Hence, in case of the light, slim panel 1, the electron beams deflected by the deflection yoke 9 are collided with the neck portion of the funnel 2, and this actually creates an area on the effective surface of the screen, where no electron beams emits light.

This BSN phenomenon consequently gives rise to another problem, such as, degraded color purity.

In order to overcome the above problems and obtain more BSN margin, a number of attempts have been made. For instance, some tried to redesign the curvature of the funnel (i.e. from 2*a* to 2*b*), or make the thickness of a glass inside of the funnel 2 thinner. The thing was that it cost too much time, efforts, and expenses. On the top of that, the depth of the funnel was prolonged in the process of redesigning the curvature of the funnel.

SUMMARY OF THE INVENTION

An object of the invention is to solve at least the above problems and/or disadvantages and to provide at least the advantages described hereinafter.

Accordingly, one object of the present invention is to solve the foregoing problems by providing a cathode ray tube, which makes it possible to conduct a full scanning on an effective surface of a screen and ensure a sufficient margin responsive to any change in color purity and beam strike neck (BSN) characteristic, not necessarily modifying already existing designs of other parts, for instance, redesigning the curvature of a funnel of the tube and reducing the thickness of a glass inside of the funnel.

Another object of the present invention is to provide a cathode ray tube, which makes it possible to conduct a full scanning on an effective surface of a screen and ensure a sufficient margin responsive to any change in color purity and beam strike neck (BSN) characteristic, not necessarily modifying already existing designs of other parts, for instance, redesigning the curvature of a funnel of the tube and reducing the thickness of a glass inside of the funnel, but moving a ½ center (i.e. deflection center) of a ferrite core of a deflection yoke in the tube.

Another object of the invention is to provide a cathode ray tube with a more BSN margin by reducing the distance from an outer surface of a holder opening part of a deflection yoke to a ½ center of a ferrite core.

Still another object of the invention is to provide a cathode ray tube with a sufficient margin for a funnel deflection angle by moving a ½ center of a ferrite core of a deflection yoke in the tube closer to the direction of a screen even though the deflection yoke might need to be retreated far behind in such case.

Yet another object of the invention is to provide a panel with a reduced thickness, given a full consideration of limitations on rescaling the interior components of a cathode ray tube (e.g. frame, shadow mask, and so on) to fit them in a light, slim panel of the tube and safety regulations set for the thickness of the panel.

The foregoing and other objects and advantages are realized by providing a cathode ray tube having a panel and a funnel tightly sealed up together, in which the panel is mounted with a fluorescent screen and a shadow mask and the funnel is mounted with an electron gun and a deflection yoke, and a predetermined color image is displayed on a the fluorescent screen as electron beams emitted from the electron gun are deflected by the deflection yoke and collided with the fluorescent screen, and satisfying a relation of $0.2 \leqq a/b \leqq 0.7$, where 'a' indicates a length of a ferrite core; and 'b' indicates a distance from a holder opening part of the deflection yoke to a rear end of the ferrite core.

Another aspect of the invention provides a cathode ray tube having a panel and a funnel tightly sealed up together, in which the panel is mounted with a fluorescent screen and a shadow mask and the funnel is mounted with an electron gun and a deflection yoke, and a predetermined color image is displayed on the fluorescent screen as electron beams emitted from the electron gun are deflected by the deflection yoke and collided with the fluorescent screen, and an outer surface of the panel is substantially flat and an inner surface of the panel has a predetermined curvature, and satisfying a relation of $0.46 \leqq a/b \leqq 0.57$, where 'a' indicates a length of a ferrite core; and 'b' indicates a distance from a holder opening part of the deflection yoke to a rear end of the ferrite core.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present a cathode ray tube according to a preferred embodiment of the invention in reference to the accompanying drawings.

Figure 1:
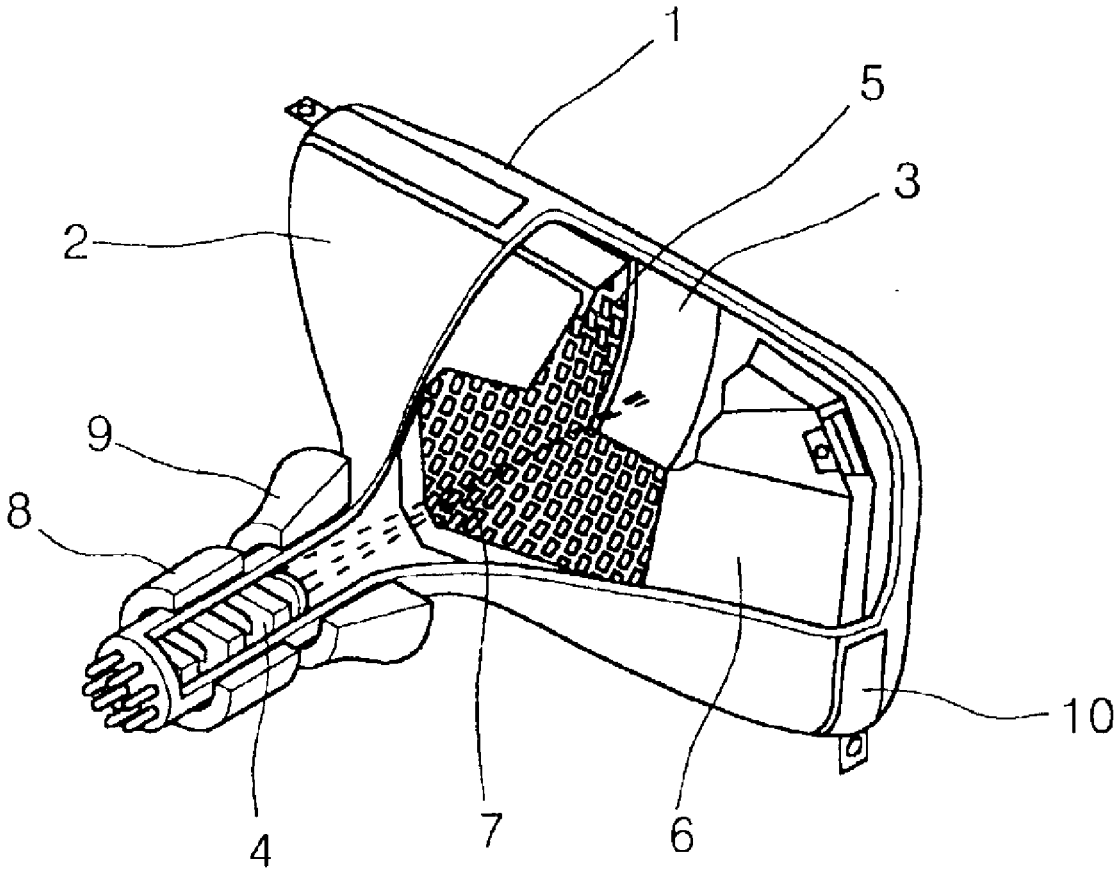
FIG. 1 (Related Art)
FIG. 1 is an explanatory diagram of a generally known color cathode ray tube according to a related art.
Figure 2:
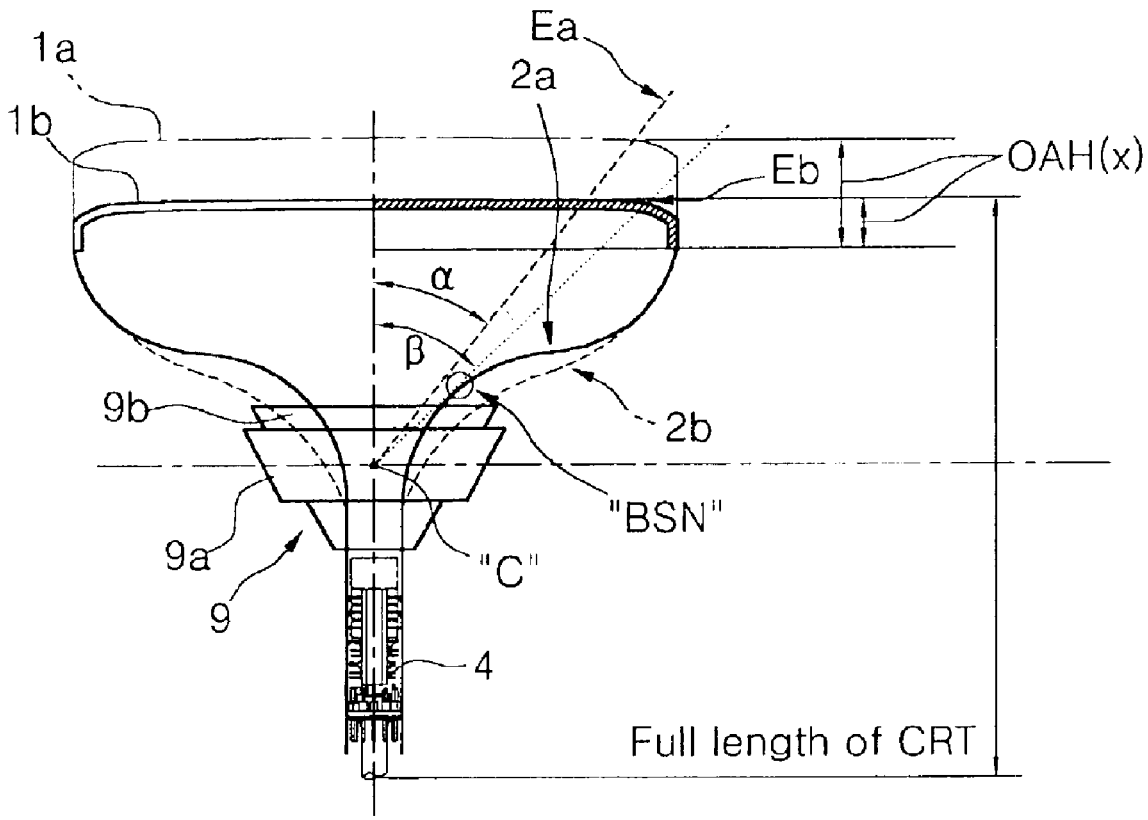
FIG. 2 (Related Art)
FIG. 2 diagrammatically explains a beam strike neck (BSN) problem caused by a slim flat type color cathode ray tube according to a related art.
Figure 3:
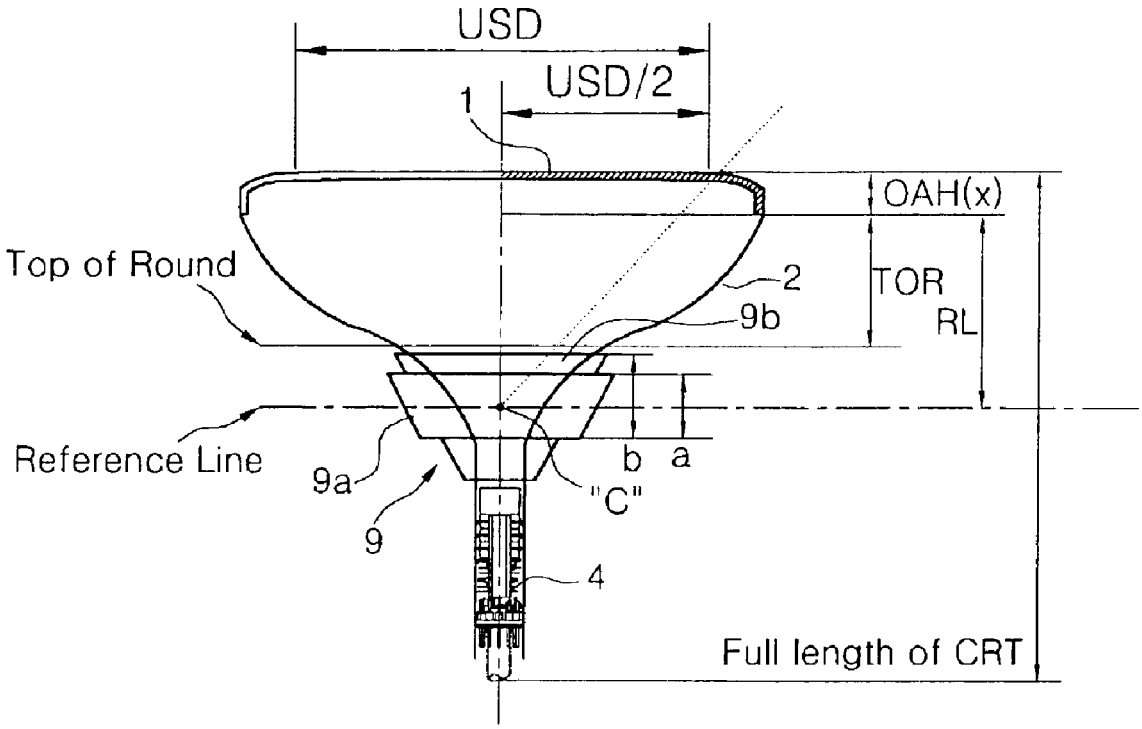
FIG. 3 is a diagram showing a relation among mechanical sizes (or dimensions) of components of a cathode ray tube according to the present invention.

FIG. 3 is a diagram illustrating a relation among mechanical dimensions of components of the cathode ray tube according to the present invention. As shown in the drawing, the color cathode ray tube includes a panel 1 with a substantially flat outer surface and an inner surface having a predetermined curvature, a shadow mask, an electron gun 4 with functions of electron beam emission/convergence/acceleration, a deflection yoke 9 for deflecting the electron beam, and a funnel 2 that is closely sealed up to the panel 1 to maintain a vacuum state.

In FIG. 3, USD indicates the diagonal length of an effective surface of the panel; RL indicates the distance from a reference line of the funnel to an extended plane of a seal edge part; OAH (x) indicates the distance from the center on the outer surface of the panel to the center on an extended plane of a skirt seal edge part; TOR indicates the distance from a Top Of Round of the funnel to the center on the extended plane of the seal edge part; and C indicates a ½ deflection center of a ferrite core.

Further, reference numeral 9*a* indicates the ferrite core; reference numeral 9*b* indicates an opening part of the deflection yoke; 'a' indicates the length of the ferrite core 9*a*' 'b' indicates the distance from an outer surface of the opening part of the deflection yoke to the rear end of the ferrite core 9*a*.

Figure 4:
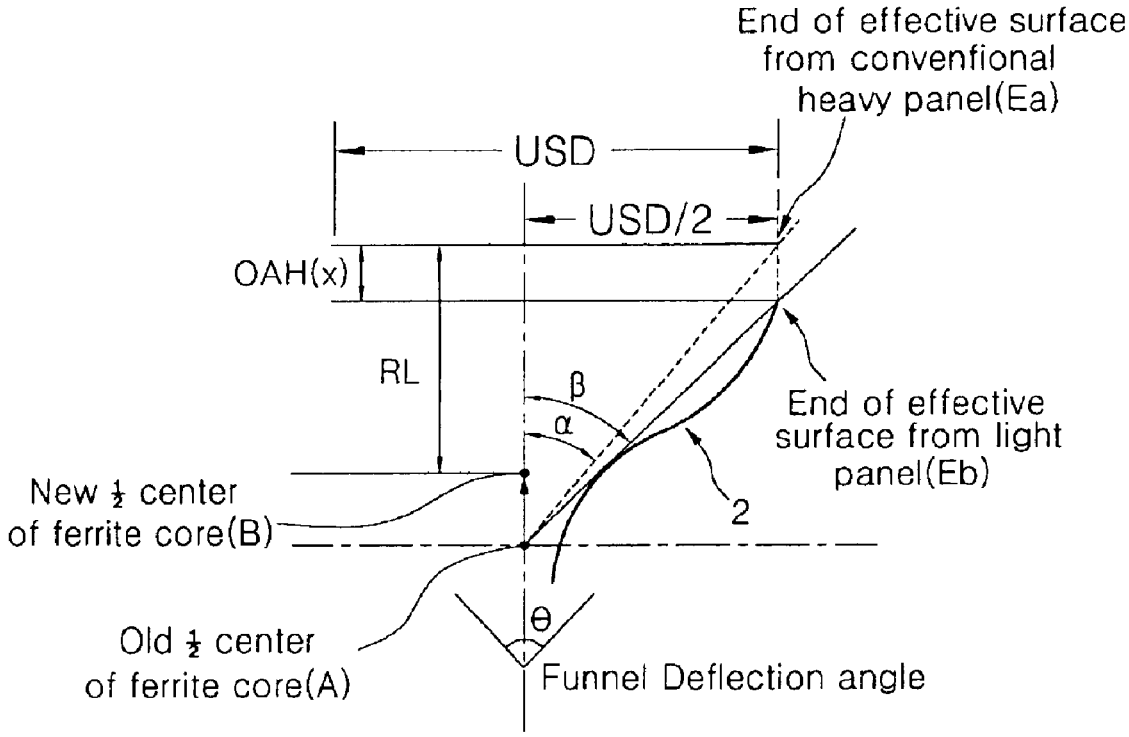
FIG. 4 diagrammatically explains how electron beams travel in the cathode ray according to the present invention.

FIG. 4 is a diagram explaining how electron beams travel in the cathode ray tube according to the present invention.

As discussed before, the panel 1 tends to become more flat, lighter, and slimmer every year, keeping abreast with the demand of consumers. As such, the electron beams deflected by the deflection yoke 9 collide with the inner surface of the neck portion of the funnel more often, and sometimes create an area that cannot illuminate a fluorescent screen inside the panel. Hence, FIG. 4 suggests a method for overcoming the above problem.

Referring to the cathode ray tube illustrated in FIGS. 3 and 4, the deflection center (C) of the deflection yoke could be designed to overlap with the ½ center of the ferrite core 9*a*. Assuming that a reference line (coordinate) exists around the ½ center (C), if an angle (α) between a vertical reference line passing the ½ center on the ferrite core 9*a* and the end (Ea) of the effective surface of the screen from the typically heavy panel is determined, a margin for the funnel's deflection angle (θ) is created, and from there, a margin of beam strike neck is created also.

On the other hand, in case of the light, slim panel, if OAH (x) (OAH (x): the distance from the center on the outer surface of the panel to the center on an extended plane of a skirt seal edge part is reduced, the angle (β) between the vertical reference line passing the original ½ center (A) on the ferrite core 9*a* and the end (Eb) of the effective surface of the screen from the light, slim panel 1 becomes greater than the angle (α). As a result thereof, the margin of the deflection angle (θ) of the funnel is decreased, and therefore, the margin of the beam strike neck is decreased as well.

To be short, the area with no electron beams is created on the effective surface of the screen primarily because the angle between the original ½ center (A) of the ferrite core 9*a* and the end (Eb) of the effective surface of the screen from the light, slim panel 1 accords with the deflection angle (θ) of the funnel 2, provoking more electron beams deflected by the deflection yoke 9 to strike the neck portion of the funnel 2. (This phenomenon corresponds to a beam strike neck (BSN) phenomenon.)

Thus, the present invention, as indicated in FIG. 4, tried to create a sufficient margin between the deflection angle (θ) of the funnel and the angle (β) between the ½ center (B) on the ferrite core 9*a* and the end (Eb) of the effective surface of the screen from the light, slim panel 1 by moving the original ½ center (A) of a ferrite core towards the front side of the cathode ray tube, more specifically, up to a ½ center (B) of the ferrite core even though it consequently made the deflection yoke to be retreated far behind.

[Embodiment 1]

Suppose that the length of the ferrite core is 'a', and the length (or distance) from the outer surface of the opening part of the deflection yoke to the rear end of the ferrite core is 'b'. Then, the ratio between two lengths, a/b, for the deflection yoke of the present invention should not be larger than 0.7, in order to secure an enough margin of the BSN especially if the panel is light and slim.

In other words, although it was perfectly fine to have the ratio, a/b, between 0.71 and 0.75 (i.e. $0.71<a/b\leqq 0.75$) for the deflection yoke in the conventional cathode ray tube, the ratio, a/b, for the deflection yoke according to the present invention should be between 0.2 and 0.7 (i.e. $0.2<a/b\leqq 0.7$), wherein 'a' indicates the width of the ferrite core and 'b' indicates the length from the outer surface of the opening part of the deflection yoke to the rear end of the ferrite core.

The above limits for the ratio a/b is obtained based on an assumption that the ½ center (B) of the ferrite core 9*a* has moved forward.

For instance, if the ratio a/b is greater than 0.7, it means that the electron beams deflected by the deflection yoke collided with the neck portion of the funnel, and thus cannot illuminate the fluorescent screen. If the ratio a/b, on the other hand, is smaller than 0.2, it means that the ferrite core for generating a magnetic force, which serves as a power source of a vertical deflection yoke, is actually absent, and as a result thereof, the deflection ability is lowered.

This brings to a conclusion that the ratio a/b should be greater than 0.2 to enable the ferrite core 9*a* to generate the magnetic field. If not, the electron beams emitted from the electron gun cannot be deflected long enough to reach the effective surface of the screen, and this resultantly makes images on the screen very small.

Therefore, the ratio a/b, that is, the ratio of the length (a) of the ferrite core to the length (b) from a holder opening part 9*b* of the deflection yoke to the rear end of the ferrite core preferably ranges from 0.2 to 0.7, i.e. $0.2\leqq a/b\leqq 0.7$.

In addition, the ratio a/b, that is, the ratio of the width (a) of the ferrite core to the length from the holder opening part of the deflection yoke 9 to the rear end of the ferrite core preferably ranges from 0.46 to 0.57, i.e. $0.46\leqq a/b\leqq 0.57$. It is so because if the ratio a/b is less than 0.46, the power consumption due to bad sensitivity is greatly increased, and if the ratio a/b exceeds 0.57, the BSN phenomenon occurs due to a wide angle deflection. Hence, a desirable range of the ratio a/b is not smaller than 0.46 and not larger than 0.57.

[Embodiment 2]

Even though the ½ center (B) of the ferrite core 9*a* to which the present invention is applied used to be selected from a range where the OAH and the TOR is in a relation of $0.56<OAH/TOR\leqq 0.57$. However, in the present embodiment, it was selected from a range where the OAH and the TOR satisfy a relation of $0.44<OAH/TOR\leqq 0.56$.

This tells that the ½ center (B) of the ferrite core has moved forward, and thus the ratio of the OAH to the TOR is between 0.44 and 0.56, i.e. $0.44<OAH/TOR\leqq 0.56$.

As aforementioned, OAH indicates the distance from the center on the outer surface of the panel 1 to the center on the extended plane of the skirt seal edge part; and TOR indicates the distance from the Top Of Round (the point where the curvature of the funnel changes) of the funnel 2 to the extended plane of the seal edge part.

If OAH/TOR is greater than 0.56, it means that the panel is fairly (or moderately) light and the length of the skirt of the panel is shortened under 12 mm. Meanwhile, if OAH/TOR is less than 0.44, it means that the panel is long enough to reach the minimum dimensional limit set for designing other interior components, e.g. a frame or a shadow mask. For that reason, the ratio of OAH to TOR is preferably larger than 0.44 and equal to/less than 0.56.

In general, if OAH/TOR is not larger than 0.44, the length of the panel skirt could be shortened by about 30 mm. In such case, it becomes very difficult to make the panel thinner than what is set on the safety regulations. Also, a dimension problem occurs in other interior components of the cathode ray tube as well. For example, the shadow mask reaches to a point where it cannot be shrunk any further, and the distance between the shadow mask to the panel becomes something that cannot be controlled simply by redesigning. For these reasons, OAH/TOR should be greater than 0.44.

More preferable range of OAH/TOR is $0.44<OAH/TOR\leqq 0.49$ because in this range, one can take the best advantage of the light panel and at the same time, make a minimum change in designing the components.

[Embodiment 3]

In this embodiment, the ½ center (B) of the ferrite core 9*a* was selected from a range where OAH and RL satisfy a relation of 0.35<OAH/(RL)≦0.43. This is quite a change, considering that the typically used range was 0.44<OAH/(RL)≦0.63.

That is, the ratio of OAH to RL now ranges from 0.35 to 0.43 as indicated above as the ½ center (B) of the ferrite core has moved forward to the direction of the cathode ray tube.

Again, OAH indicates the distance from the center on the outer surface of the panel 1 to the extended plane of the skirt seal edge part; and RL indicates the distance from the approximate reference line to the extended plane of the seal edge part.

If OAH/(RL) is greater than 0.43, it means that the panel is fairly (or moderately) light and the length of the skirt of the panel is shortened under 12 mm. Meanwhile, if OAH/(RL) is less than 0.35, it means that the panel skirt is long enough to reach the minimum dimensional limit set for designing other interior components, e.g. a frame or a shadow mask. Besides, as the deflection angle changes, other major components of the cathode ray tube, such as, the electron gun and the deflection yoke, should be redesigned, and power consumption of deflection is increased. For these reasons, the ratio of OAH to RL is preferably larger than 0.35 and equal to or less than 0.43

More preferable range of OAH/(RL) is 0.35<OAH/(RL)≦0.43 because in this range, one can take the best advantage of the light panel and at the same time, make a minimum change in designing the components As long as the ratio of OAH/(RL) remains within the above range, the existing deflection angle does not have to be changed: power consumption is not increased since the deflection angle remains the same: and the panel can be much lighter simply by adjusting the height of interior components, not necessarily giving damage on the components.

Shortly speaking, the panel skirt can be shortened by 12 mm up to 20 mm, and the deflection angle does not need to be changed.

[Embodiment 4]

Even though the ½ center (B) of the ferrite core 9*a* to which the present invention is applied used to be selected from a range where the USD/2 and the TOR is in a relation of 1.59<(USD/2)/TOR≦2.40. However, in the present embodiment, it was selected from a range where the OAH and the TOR satisfy a relation of 1.47<(USD/2)/TOR≦1.58.

This tells that the ½ center (B) of the ferrite core has moved forward in the direction of the cathode ray tube, and thus the ratio of the (USD/2) to the TOR is between 1.47 and 1.58, i.e. 1.47<(USD/2)/TOR≦1.58.

Here, USD/2 indicates a half of the diagonal length on the effective surface of the panel; and TOR indicates the distance from the Top Of Round (the point where the curvature of the funnel changes) of the funnel 2 to the extended plane of the seal edge part.

If (USD/2)/TOR is not larger than 1.47, it means that the panel is fairly (or moderately) light and the length of the skirt of the panel is shortened under 12 mm. Meanwhile, if (USD/2)/TOR is greater than 1.58, it means that the panel is long enough to reach the minimum dimensional limit set for designing other interior components, e.g. a frame or a shadow mask. For that reason, the ratio of (USD/2) to TOR is preferably larger than 1.47 and equal to/less than 1.58.

[Embodiment 5]

In this embodiment, the ½ center (B) of the ferrite core 9*a* was selected from a range where (USD/2) and RL satisfy a relation of 1.16<(USD/2)/(RL)≦1.23. This is quite a change, considering that the typically used range was 1.24<(USD/2)/(RL)≦1.91.

That is, the ratio of (USD/2) to RL now ranges from 1.16 to 1.23 as indicated above as the ½ center (B) of the ferrite core has moved forward to the direction of the cathode ray tube.

Again, USD/2 indicates a half of the diagonal length on the effective surface of the panel; and RL indicates the distance from the approximate reference line to the extended plane of the seal edge part.

If (USD/2)/RL is not larger than 1.16, it means that the panel is fairly (or moderately) light and the length of the skirt of the panel is shortened under 12 mm. Meanwhile, if (USD/2)/RL is greater than 1.23, it means that the panel is long enough to reach the minimum dimensional limit set for designing other interior components, e.g. a frame or a shadow mask. For that reason, the ratio of (USD/2) to RL is preferably larger than 1.16 and equal to/less than 1.23.

Figure 5:
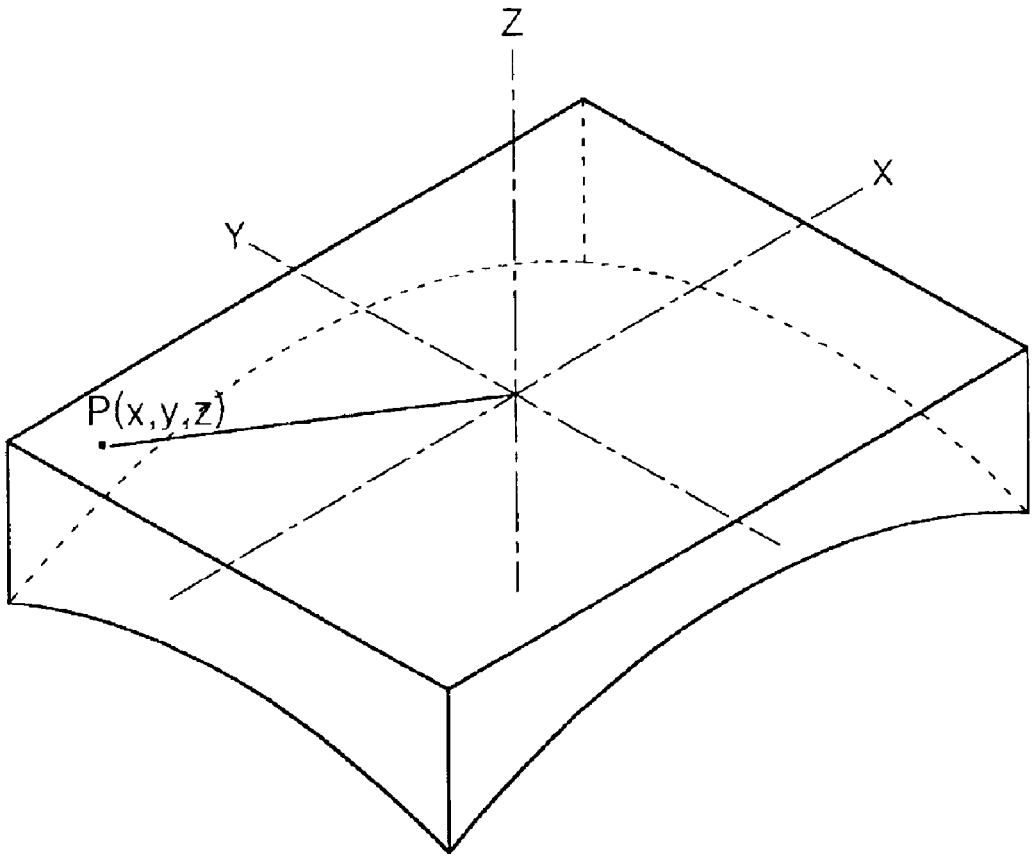
FIG. 5 is an explanatory diagram of an effective surface of a light panel for the cathode ray tube according to the present invention.

FIG. 5 is an explanatory diagram of the effective surface on the light panel for the cathode ray tube according to the present invention.

As depicted in the drawing, suppose there is a point, P (x, y, z), on the panel's the outer surface that is substantially flat. Then, the curvature radius of the panel's outer surface can be expressed by the following equation:

$$\text{Curvature radius} = \frac{\left(\sqrt{x^2+y^2}\right)^2 + z^2}{2\times z} \qquad \text{[Mathematical equation 1]}$$

Here, provided that (0,0,0) is the center of the panel's outer surface, namely origin of coordinates, (x, y, z) is an arbitrary point on the x-y-z coordinate system, being distant from the origin by |x|, |y|, and |z|.

As for the panel for the cathode ray tube having a substantially flat outer surface and predetermined curvature, any arbitrary point P (x, y, z) on the panel's outer surface is desired to satisfy a relation of $$30{,}000\ \text{mm} \le \frac{\left(\sqrt{x^2+y^2}\right)^2 + z^2}{2\times z}.$$

If the above requirement is met, that is, if the point P (x, y, z) satisfies the relation of $$30{,}000\ \text{mm} \le \frac{\left(\sqrt{x^2+y^2}\right)^2 + z^2}{2\times z},$$

it becomes possible to make the screen even more flat.

Moreover, the curvature radius for the inner surface of the panel is preferably in range of 1.2R to 8R (where, R=1.767× diagonal length of the effective surface of the panel).

In this way, the structural strength of the shadow mask and the panel can be improved, and the visual difficulty due to an uneven brightness problem can be prevented.

The cathode ray tube of the present invention can be advantageously used especially for slim, light color televisions nowadays.

In conclusion, the panel of the cathode ray tube according to the present invention has a number of merits; for instance, its flat outer surface contributes to minimizing the distortion of images, manufacture cost for the light, slim panel is greatly cut down, and there is no need to redesign the funnel simply for preventing degraded color purity on the screen caused by the BSN phenomenon because this problem can be easily fixed by translating the ½ center of the ferrite core of the deflection yoke to an appropriate position.

In addition, one can conduct a full scanning on the effective surface of the screen and secure a sufficient margin for changes in color purity and the BSN problem by translating the ½ center of the ferrite core of the deflection yoke mounted in the cathode ray tube according to the present invention, so there is no need to redesign the curvature of the funnel and reduce the thickness of the glass inside of the funnel.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A cathode ray tube, comprising:

a panel and a funnel tightly sealed up together, in which the panel is mounted with a fluorescent screen and a shadow mask and the funnel is mounted with an electron gun and a deflection yoke, and a predetermined color image is displayed on a the fluorescent screen as electron beams emitted from the electron gun are deflected by the deflection yoke and collided with the fluorescent screen; and a ratio of a length, 'a', of a ferrite core to a distance, 'b', from a holder opening part of the deflection yoke to a rear end of the ferrite core satisfies a relation of $0.2 \leqq a/b \leqq 0.7$ and a ratio of a distance, OAH, between a center of an outer surface of the panel to an extended plane of a skirt seal edge part to a distance, TOR, between a Top Of Round of the funnel and an extended plane of a seal edge part satisfies a relation of $0.44 < OAH/TOR \leqq 0.56$.

2. The cathode ray tube according to claim 1, wherein the cathode ray tube is for a color television.

3. The cathode ray tube according to claim 1, wherein the ratio of the length, 'a', of the ferrite core to the distance, 'b', from the holder opening part of the deflection yoke to the rear end of the ferrite core satisfies a relation of $0.46 \leqq a/b \leqq 0.57$.

4. The cathode ray tube according to claim 3, wherein the cathode ray tube is for a color television.

5. A cathode ray tube, comprising:

a panel and a funnel tightly sealed up together, in which the panel is mounted with a fluorescent screen and a shadow mask and the funnel is mounted with an electron gun and a deflection yoke, and a predetermined color image is displayed on a the fluorescent screen as electron beams emitted from the electron gun are deflected by the deflection yoke and collided with the fluorescent screen; and a ratio of a length, 'a', of a ferrite core to a distance, 'b', from a holder opening part of the deflection yoke to a rear end of the ferrite core satisfies a relation of $0.2 \leqq a/b \leqq 0.7$; wherein a ratio of the distance, OAH, between a center of an outer surface of the panel to an extended plane of a skirt seal edge part to a distance, RL, between a reference line of the funnel and the extended plane of the seal edge part satisfies a relation of $0.35 < OAH/(RL) \leqq 0.43$.

6. A cathode ray tube, comprising:

a panel and a funnel tightly sealed up together, in which the panel is mounted with a fluorescent screen and a shadow mask and the funnel is mounted with an electron gun and a deflection yoke, and a predetermined color image is displayed on a the fluorescent screen as electron beams emitted from the electron gun are deflected by the deflection yoke and collided with the fluorescent screen; and a ratio of a length, 'a', of a ferrite core to a distance, 'b', from a holder opening part of the deflection yoke to a rear end of the ferrite core satisfies a relation of $0.2 \leqq a/b \leqq 0.7$; wherein a ratio of a half of a diagonal length, USD/2, of an effective surface of the panel to the distance, TOR, between the Top Of Round of the funnel and the extended plane of the seal edge part satisfies a relation of $1.47 < (USD/2)/TOR \leqq 1.58$.

7. A cathode ray tube, comprising:

a panel and a funnel tightly sealed up together, in which the panel is mounted with a fluorescent screen and a shadow mask and the funnel is mounted with an electron gun and a deflection yoke, and a predetermined color image is displayed on a the fluorescent screen as electron beams emitted from the electron gun are deflected by the deflection yoke and collided with the fluorescent screen; and a ratio of a length, 'a', of a ferrite core to a distance, 'b', from a holder opening part of the deflection yoke to a rear end of the ferrite core satisfies a relation of $0.2 \leqq a/b \leqq 0.7$; wherein a ratio of the half of the diagonal length, USD/2, of the effective surface of the panel to the distance, RL, between the reference line of the funnel and the extended plane of the seal edge part satisfies a relation of $1.16 < (USD/2)/(RL) \leqq 1.23$.

8. The cathode ray tube according to claim 7, wherein a ratio of a distance, OAH, between a center of an outer surface of the panel to an extended plane of a skirt seal edge part to a distance, TOR, between a Top Of Round of the funnel and an extended plane of a seal edge part satisfies a relation of $0.44 < OAH/TOR \leqq 0.56$.

9. A cathode ray tube, comprising:

a panel and a funnel tightly sealed up together, in which the panel is mounted with a fluorescent screen and a shadow mask and the funnel is mounted with an electron gun and a deflection yoke, and a predetermined color image is displayed on a the fluorescent screen as electron beams emitted from the electron gun are deflected by the deflection yoke and collided with the fluorescent screen; wherein a ratio of the distance, OAH, between a center of an outer surface of the panel to an extended plane of a skirt seal edge part to a distance, RL, between a reference line of the funnel and the extended plane of the seal edge part satisfies a relation of $0.35 < OAH/(RL) \leqq 0.43$.

10. A cathode ray tube, comprising:

a panel and a funnel tightly sealed up together, in which the panel is mounted with a fluorescent screen and a shadow mask and the funnel is mounted with an electron gun and a deflection yoke, and a predetermined color image is displayed on a the fluorescent screen as electron beams emitted from the electron gun are deflected by the deflection yoke and collided with the fluorescent screen; wherein a ratio of a half of a diagonal length, USD/2, of an effective surface of the panel to the distance, TOR, between the Top Of Round of the funnel and the extended plane of the seal edge part satisfies a relation of $1.47<(USD/2)/TOR\leqq 1.58$.

11. A cathode ray tube, comprising:

a panel and a funnel tightly sealed up together, in which the panel is mounted with a fluorescent screen and a shadow mask and the funnel is mounted with an electron gun and a deflection yoke, and a predetermined color image is displayed on a the fluorescent screen as electron beams emitted from the electron gun are deflected by the deflection yoke and collided with the fluorescent screen; wherein a ratio of the half of the diagonal length, USD/2, of the effective surface of the panel to the distance, RL, between the reference line of the funnel and the extended plane of the seal edge part satisfies a relation of $1.16<(USD/2)/(RL)\leqq 1.23$.

12. A cathode ray tube, comprising:

a panel and a funnel tightly sealed up together, in which the panel is mounted with a fluorescent screen and a shadow mask and the funnel is mounted with an electron gun and a deflection yoke, and a predetermined color image is displayed on a the fluorescent screen as electron beams emitted from the electron gun are deflected by the deflection yoke and collided with the fluorescent screen, and an outer surface of the panel is substantially flat and an inner surface of the panel has a predetermined curvature; and a ratio of a length, 'a', of a ferrite core to a distance, 'b', from a holder opening part of the deflection yoke to a rear end of the ferrite core satisfies a relation of $0.46\leqq a/b\leqq 0.57$ and a ratio of a distance, OAH, between a center of an outer surface of the panel to an extended plane of a skirt seal edge part to a distance, TOR, between a Top Of Round of the funnel and an extended plane of a seal edge part satisfies a relation of $0.44<OAH/TOR\leqq 0.56$.

13. The cathode ray tube according to claim 12, wherein the curvature radius of the inner surface of the panel ranges from 1.2R to 8R, given R=1.767×diagonal length of an effective surface of the panel.

14. The cathode ray tube according to claim 12, wherein a curvature radius of the outer surface of the panel is equal to or greater than 30,000 mm.

15. The cathode ray tube according to claim 14, wherein the curvature radius of the inner surface of the panel ranges from 1.2R to 8R, given R=1.767×diagonal length of an effective surface of the panel.

16. The cathode ray tube according to claim 12, wherein the cathode ray tube is for a color television.

17. A cathode ray tube, comprising:

a panel and a funnel tightly sealed up together, in which the panel is mounted with a fluorescent screen and a shadow mask and the funnel is mounted with an electron gun and a deflection yoke, and a predetermined color image is displayed on a the fluorescent screen as electron beams emitted from the electron gun are deflected by the deflection yoke and collided with the fluorescent screen, and an outer surface of the panel is substantially flat and an inner surface of the panel has a predetermined curvature; and a ratio of a length, 'a', of a ferrite core to a distance, 'b', from a holder opening part of the deflection yoke to a rear end of the ferrite core satisfies a relation of $0.46\leqq a/b\leqq 0.57$; wherein a ratio of the distance, OAH, between a center of an outer surface of the panel to an extended plane of a skirt seal edge part to a distance, RL, between a reference line of the funnel and the extended plane of the seal edge part satisfies a relation of $0.35<OAH/(RL)\leqq 0.43$.

18. A cathode ray tube, comprising:

a panel and a funnel tightly sealed up together, in which the panel is mounted with a fluorescent screen and a shadow mask and the funnel is mounted with an electron gun and a deflection yoke, and a predetermined color image is displayed on a the fluorescent screen as electron beams emitted from the electron gun are deflected by the deflection yoke and collided with the fluorescent screen, and an outer surface of the panel is substantially flat and an inner surface of the panel has a predetermined curvature; and a ratio of a length, 'a', of a ferrite core to a distance, 'b', from a holder opening part of the deflection yoke to a rear end of the ferrite core satisfies a relation of $0.46\leqq a/b\leqq 0.57$; wherein a ratio of a half of a diagonal length, USD/2, of an effective surface of the panel to the distance, TOR, between the Top Of Round of the funnel and the extended plane of the seal edge part satisfies a relation of $1.47<(USD/2)/TOR\leqq 1.58$.

19. A cathode ray tube, comprising:

a panel and a funnel tightly sealed up together, in which the panel is mounted with a fluorescent screen and a shadow mask and the funnel is mounted with an electron gun and a deflection yoke, and a predetermined color image is displayed on a the fluorescent screen as electron beams emitted from the electron gun are deflected by the deflection yoke and collided with the fluorescent screen, and an outer surface of the panel is substantially flat and an inner surface of the panel has a predetermined curvature; and a ratio of a length, 'a', of a ferrite core to a distance, 'b', from a holder opening part of the deflection yoke to a rear end of the ferrite core satisfies a relation of $0.46\leqq a/b\leqq 0.57$; wherein a ratio of the half of the diagonal length, USD/2, of the effective surface of the panel to the distance, RL, between the reference line of the funnel and the extended plane of the seal edge part satisfies a relation of $1.16<(USD/2)/(RL)\leqq 1.23$.

* * * * *